United States Patent [19]

Thistlethwaite

[11] 4,048,771

[45] Sept. 20, 1977

[54] DOOR FRAMING FIXTURE AND METHOD

[75] Inventor: Mark K. Thistlethwaite, Toledo, Ohio

[73] Assignee: The Vicon Supply Company, Toledo, Ohio

[21] Appl. No.: 686,308

[22] Filed: May 14, 1976

[51] Int. Cl.[2] ..... E04G 23/00

[52] U.S. Cl. ..... 52/127

[58] Field of Search ..... 52/127, 204; 248/354 R

[56] References Cited

U.S. PATENT DOCUMENTS

| | | | |
|---|---|---|---|
| 2,914,812 | 12/1959 | Christian et al. | 52/127 |
| 2,914,813 | 12/1959 | Christian et al. | 52/127 |

FOREIGN PATENT DOCUMENTS

| | | | |
|---|---|---|---|
| 44,287 | 6/1971 | Finland | 52/127 |

*Primary Examiner*—J. Karl Bell

*Attorney, Agent, or Firm*—Richard D. Emch

[57] ABSTRACT

A door framing-fixture and method is disclosed. The fixture includes a top member, a bottom member and a pair of opposed side members.

The members are connected together to form a rectangular fixture complementary with the interior of a metallic door frame having opposed jambs and a connecting header. Brace members are located adjacent the bottom member and extend rearwardly for connection to the jambs. A cross member extends between the opposed side members. After the fixture is installed in the metallic door frame, the door frame-fixture assembly is positioned at a desired door location and a wall is constructed adjacent the assembly. The wall is connected to the metallic door frame. The fixture is removed from the frame prior to installing a door.

14 Claims, 10 Drawing Figures

FIG. 1
PRIOR ART
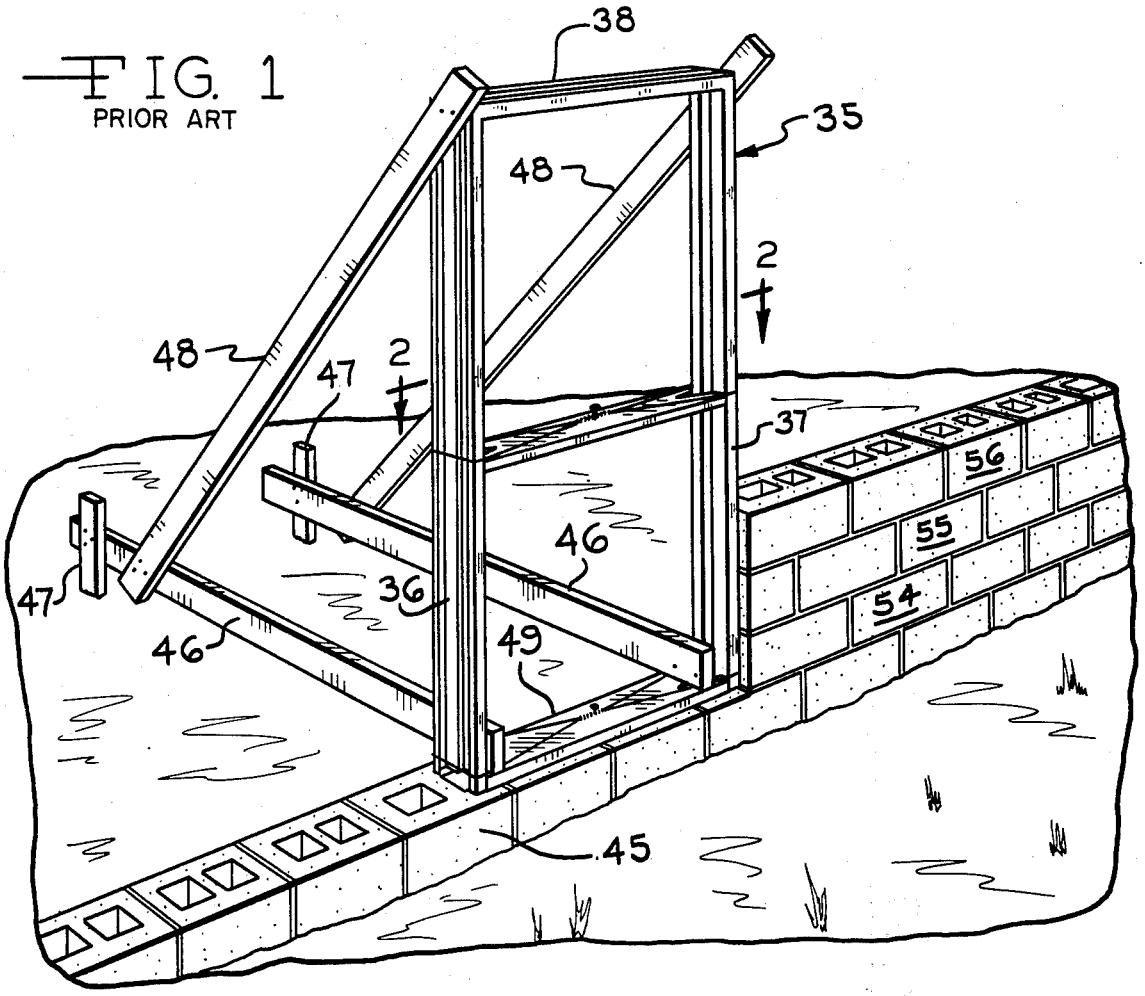
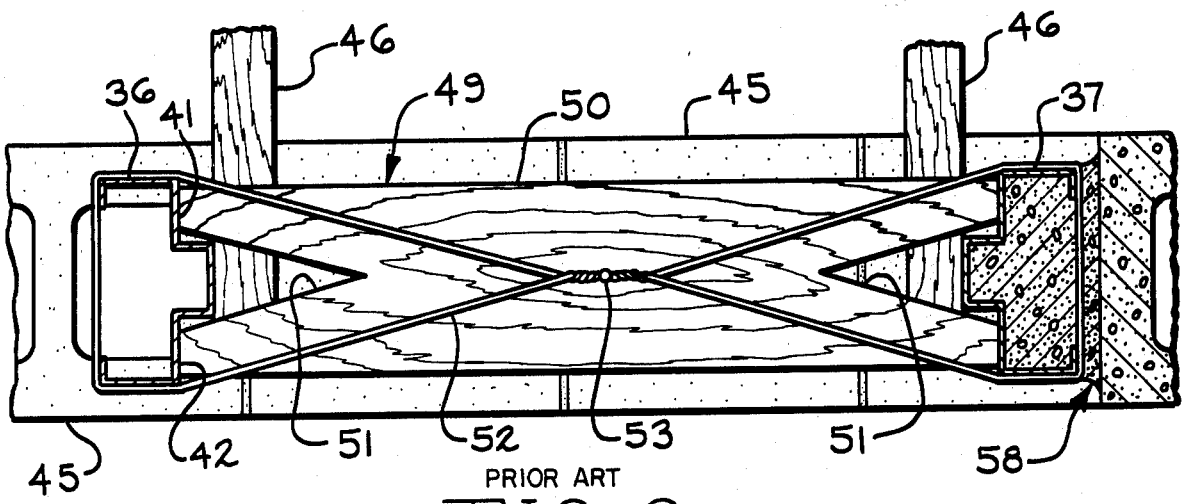
PRIOR ART
FIG. 2

FIG. 3
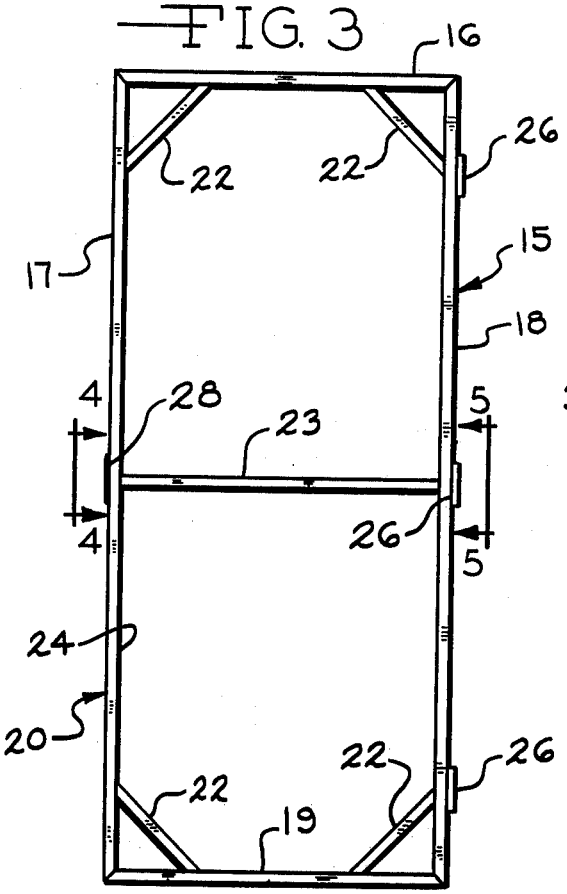
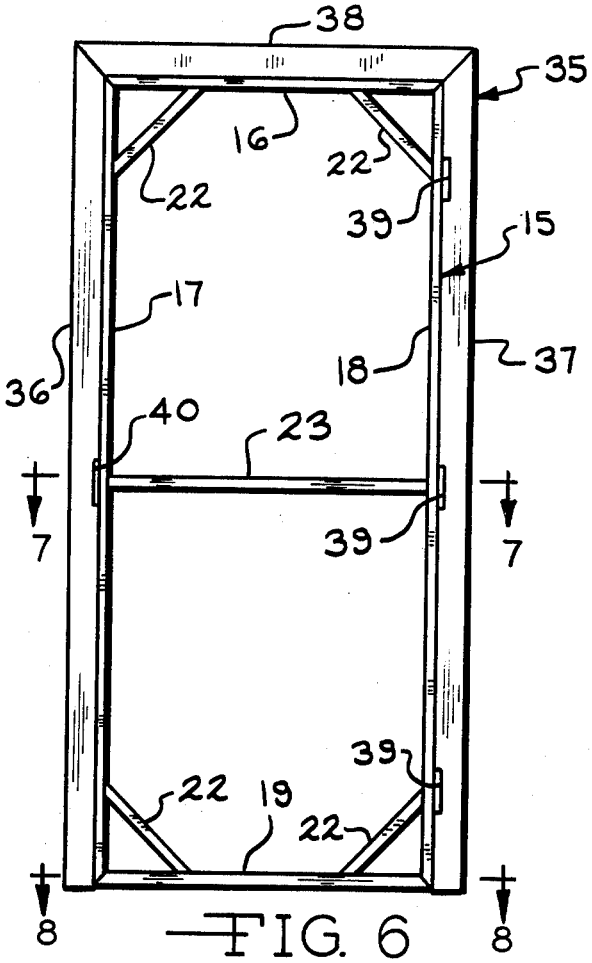
FIG. 6
FIG. 4
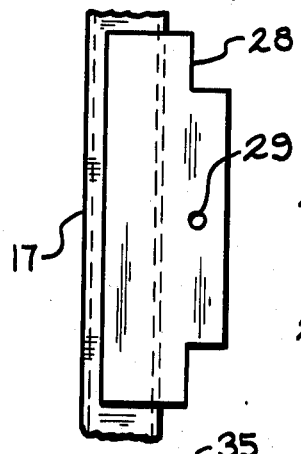
FIG. 5
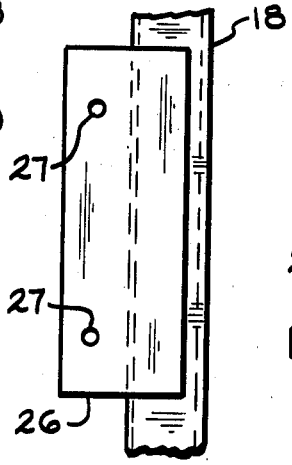
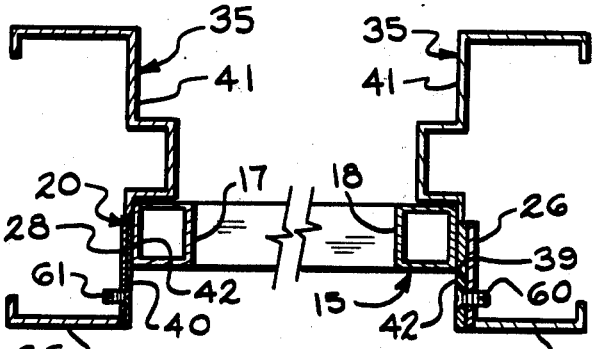
FIG. 7
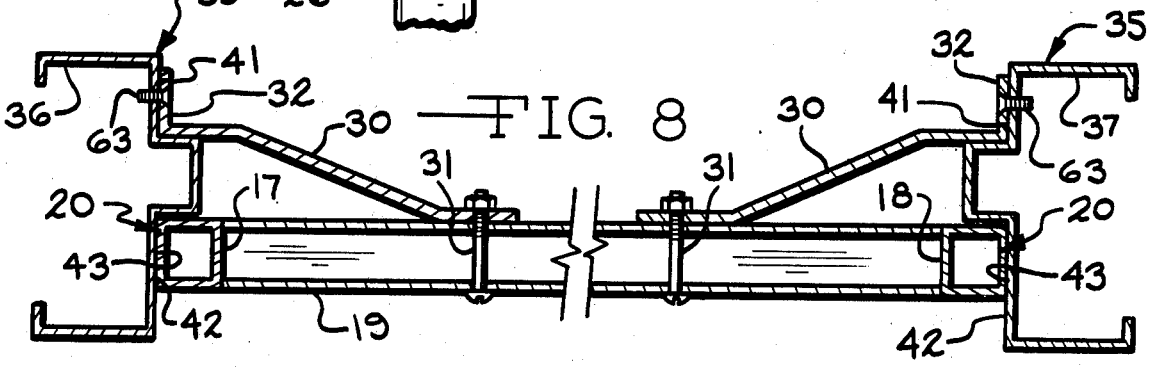
FIG. 8

FIG. 9
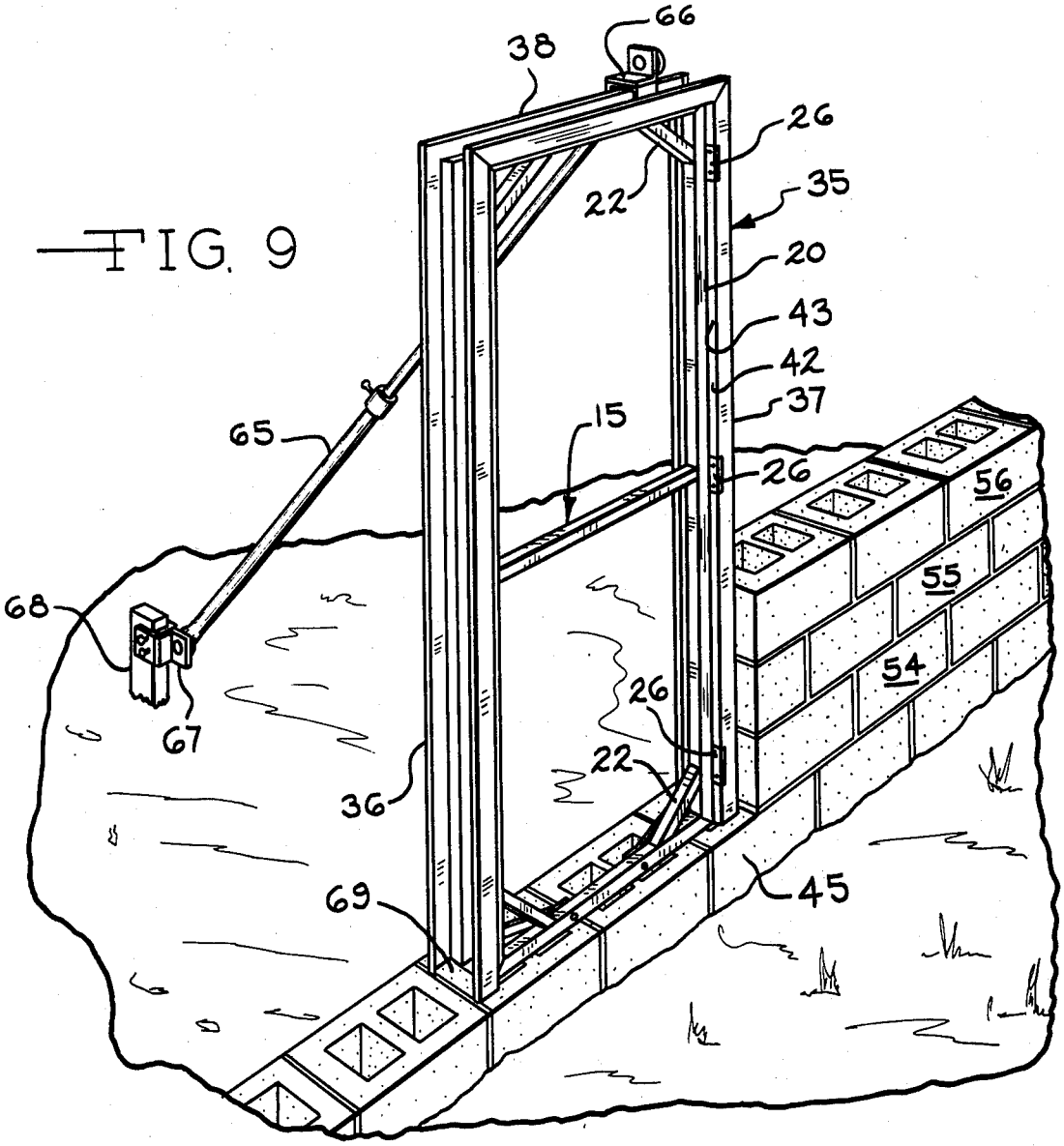
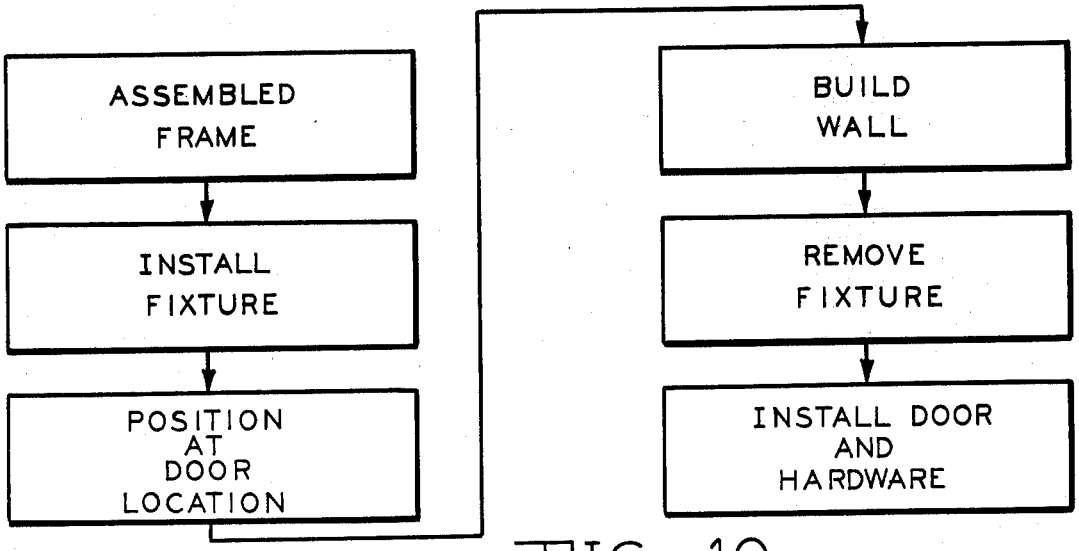
FIG. 10

DOOR FRAMING FIXTURE AND METHOD

BACKGROUND OF THE INVENTION

In recent years the use of metallic doors and metallic door frames, particularly in industrial and commerical construction has greatly increased. For examples, for safety reasons, most hospitals, nursing homes and the like utilize metallic doors which serve as fire barriers.

Often during construction, the frameworks for the metallic doors are positioned in the field shortly after construction has begun. In fact, this is often done prior to the installation of any floors, shortly after the footers have been constructed for either the perimeter walls or the interior bearing walls.

When using wooded doors, including wooden prehung door assemblies, if the door framing is improperly installed, it is normally relatively easy to correct the defect. For example, if the vertical jambs of the frame are installed in a non-parallel position or in a position wherein at least one of the frames is not in a vertical plane, it is usually possible with wooden door assemblies to shim the entire structure so that the door itself can be properly installed. Similarly, if the installed door frame is not rectangular, it is often possible to plane one edge of the door and to realign the hinges so that the door will fit within the frame.

Unfortunately, it is very difficult to properly install a metal door if the metallic door frame has been improperly installed. Because of the normal construction practice of installing the metallic frame early during the construction process, the door frame is very easily misaligned during the construction process, for example, when the masonry or concrete walls are installed adjacent the door frame. When this occurs, the metallic door will not fit within the door frame and it is difficult to make a correction in the field. If there is only a slight misalignment, in the past, the metallic door has been ground to enable its installation or, for example, some tolerances are provided by bending or adjusting the hinges. However, these are field expediences and the installed assembly is often less than desirable in the final building construction. If the alignment of the metallic door frames is too great, it is sometimes necessary to install an undersized door in the frame. Again, the final assembly does not give the performance that it should in the completed building. In the past, inspectors and architects have had little choice in allowing these types of field expedients. The alternative was to tear down and bebuild at least a portion of the wall surrounding the metallic door frame so that the frame could be reinstalled in a proper manner.

SUMMARY OF THE INVENTION

The present invention is directed to a door framing-fixture and a method of installing a metallic frame during building construction. A metallic frame includes a pair of vertical jambs interconnected by a header. The framing fixture, according to the present invention, defines a rectangular periphery which is complementary with the interior of the door frame. The fixture includes a top member, a bottom member, and a pair of opposed side members. Brace members are located adjacent the bottom member and extend rearwardly for connection to the jamb.

After the fixture is installed in a metallic door frame, the door frame-fixture assembly is positioned at a desired door location. The wall is constructed adjacent the assembly, and connected to the metallic door frame. The fixture is removed from the frame prior to installing a door. The door framing fixture and method, according to the present invention, greatly reduce the chances that the metallic door frame will be misaligned during construction.

DESCRIPTION OF THE DRAWINGS

FIG. 1 is a fragmentary, perspective view, showing a typical prior art method of installing a metallic door frame during the construction of a building;

FIG. 2 is an enlarged sectional view taken along the line 2–2 of FIG. 1 and showing in particular a typical prior art brace;

FIG. 3 is an elevational view of a door framing-fixture, according to the present invention;

FIG. 4 is a fragmentary side view, shown on an enlarged scale and taken along the line 4—4 of FIG. 3;

FIG. 5 is a fragmentary side view, shown on an enlarged scale and taken along the line 5—5 of FIG. 3;

FIG. 6 is an elevational view, similar to FIG. 3 showing a door framing-fixture, according to the present invention, installed in a metallic door frame;

FIG. 7 is a sectional view, with a portion broken away, shown on an enlarged scale, and taken along the line 7—7 of FIG. 6;

FIG. 8 is a sectional view with a portion broken away, shown on an enlarged scale, and taken along the line 8—8 of FIG. 6;

FIG. 9 is a fragmentary, perspective view showing a door framing-fixture installed in a metallic frame, positioned at a door opening in a building under construction; and FIG. 10 is a box diagram representation of the steps of a method of installing a metallic frame during building construction, according to the present invention.

DESCRIPTION OF THE PREFERRED EMBODIMENTS

Referring to the drawings, a door framing-fixture, according to the present invention, is generally indicated in FIG. 3 by the reference number 15. The door framing-fixture 15 includes a top member 16, a pair of opposed side members 17 and 18, and a bottom member 19. The top member 16, bottom member 19, and side member 17 and 18 are connected together by welding, or other suitable means to form a rectangular outer periphery, generally indicated by the reference number 20.

The members 16-19 are preferably constructed of steel tubing. Referring to FIGS. 7 and 8, it has been found that steel tubing having the rectangular configuration shown is particularly beneficial in providing the rigidity and stability needed in the door framing-fixture 15.

Referring to FIG. 3, corner braces 22 are positioned adjacent the intersections of the members 16–19. In the present embodiment, a cross member 23 is connected to and extends between the parallel side members 17 and 18 at the approximate mid-point of the door framing-fixture 15. The cross member 23, the lower portion of the opposed side members 17 and 18, the lower corner braces 22, and the central portion of the bottom member 19 define a wheelbarrow opening, generally indicated by the reference number 24. Referring to FIGS. 3 and 5, rectangular guide plates 26 are welded or otherwise connected to the side member 18. The guide plates 26 define a pair of openings 27. A T-shaped guide plate 28 is welded or otherwise connected to the opposed side member 17. The T-shaped guide plate 28 defines an opening 29. Referring to FIG. 8, a pair of brace members 30 are connected to the bottom member 19 by a pair of bolts 31 or other suitable means. The brace members 30 extend rearwardly from the bottom member 19 and include offset leg portions 32, as shown in FIG. 8.

Referring to FIG. 6, the door framing-fixture 15, according to the present invention, is used in connection with the installation of a metallic frame, generaly indicated by the reference number 35. The frame 35 includes two opposed jambs 36 and 37 which are connected by a header. Referring to FIG. 6, the jamb 37 defines three hinge plate recesses 39, while the jamb 36 defines a strike plate recess 40. As shown in FIGS. 7 and 8, in this particular embodiment, the jambs 36, 37, and the header 38 include inner and outer rabbets 41 and 42. The fixture 15, according to the present invention may also be used in connection with other metallic door frame configurations, including single rabbet jambs as well as other styles of double rabbet jambs. As shown in FIG. 8, the outer rabbet 42 defines an inner surface, generally indicated by the reference number 43. When the door framing-fixture 15 is positioned within the metallic frame 35, the outer periphery 20 of the fixture 15 is complementary with the inner surface 43 of the frame 35.

During a typical method of installing the metal frame 35 during a building construction project, the first step is to adjust the metallic door frame 35 which includes the pair of opposed jambs 36 and 37 and the connecting header 38. The adjustment step either includes actually assembling the jamb and header members into the U-shaped, right angle configuration shown in FIG. 6 or, if the members are already connected, the adjustment step includes positioning and squaring the connected frame members.

Referring to FIGS. 1 and 2, under a typical prior art method, a foundation was poured at a wall location and concrete block laid upwardly to the course 45, indicated in FIG. 1. The metallic door frame 35 was then positioned at the desired door location. The contractor would then align and plumb the metallic frame 35 to insure that the frame 35 was in proper vertical plane and that the jambs 36 and 37 were parallel. Horizontal wooden braces 46 were then connected to the lower portions of the jambs 36 and 37 and secured by stakes 47. Often, diagonal wood braces 48 were connected between the header 38 and the horizontal braces 46. Because the jambs 36 and 37 are placed under side loading as the wall is constructed and also because the lower ends of the jambs 36 and 37 were not interconnected, additional cross brace assemblies 49 were also often used. A length of wood 50, such as a two by six, was cut to the width of the header 38, and notches 51 were formed in each end. The bifurcated notched ends were positioned in the rabbets 41 and 42. Lastly, a length of wire 52 was wrapped in the shape of a figure 8 around the exteriors of the opposed jambs 36 and 37. The wire 52 was then wrapped around a nail 53. By twisting the nail 53, the wire 52 was placed under tension. After tensioning, the nail 53 was driven into the length of wood 50. If done properly, the cross brace assemblies 49 would hold the jambs 36 and 37 in a parallel relationship during construction. The length of wood 50 protected against side compression loading and the wire 52 protected against side tension loadings. However, it is obvious that there was room for mistake even in the initial bracing. If the lengths of wood 50 were improperly sized, warped, placed on a cant, or improperly notched, the jambs 36 and 37 were not parallel after construction. Furthermore, when using the prior art method shown in FIGS. 1 and 2, the construction of the subsequent block courses 54, 55, 56, etc., often subjected the metallic door frame 35 to misalignment. Normally the metallic frame 35 is not installed by the masonry subcontractor. As each of the block courses 54–56, etc. are constructed, they are adjoined to the jambs 36 and 37 by grout, generally indicated in FIG. 2 by the reference number 58. If, for examples, the lower portion of the jamb 37 is struck by a block or is shifted during the grouting step, the jambs 36 and 37 possibly will remain in a parallel relationship, however, the lower ends are displaced into separate vertical planes. Because the door frames 35 are placed on the construction site during an initial phase of the building projects, after the walls are partially constructed, the frames are utilized as a means of ingress and egress to different areas of construction. Again, bumping can displace or misalign the metallic frame 35 as wheelbarrows and people move through the frames 35.

Referring now to FIGS. 9 and 10, under the present method, after the metallic door frame 35 is adjusted, which, as mentioned above, comprises either actually assembling the door frame or squaring its assembled members, the door framing-fixture 15, according to the present invention, is installed within the metallic door frame 35. The outer periphery 20 of the door framing-fixture 15 lies in a snug complementary relationship with the inner surface 43 of the metallic door frame 35, defined by the outer rabbet 42. Referring to FIG. 7, the guide plates 26 of the fixture 15 together with the T-shaped guide plate 28 are received by the hinge plate recesses 39 and the strike plate recess 40, respectively, of the metallic frame 35. The guide plates 26 are connected to the jamb 37 by self-tapping screws 60 inserted in the guide plate openings 27. Similarly, the T-shaped guide plate 28 is connected to the jamb 36 by a self-tapping screw 61 inserted in the guide plate opening 29.

The mating relationship between the guide plates 26, the hinge plate recesses 39, and the guide plate 28 and its strike plate recess 40 have several purposes. It has been found that the mating of the plates and recesses insures a correct alignment of the metallic frame 35 and also aids in securing the opposed jambs 36 and 37 from accidental displacement into different vertical planes. Furthermore, the guide plates 26 and 28 serve as barriers to the grout 58 or to concrete if a reinforced concrete wall is being poured. Therefore, by using the present method, chipping of grout or concrete prior to the installation of door hardware is minimized.

During the installation of the fixture 15, the brace members 30 are connected to the opposed jambs 36 and 37. The off-set leg portions 32 of the brace members 30 are positioned in mating relationship with the inner rabbets 41 and secured in position by screws or other fasteners 63. It has been found that the braces 30 are effective in preventing displacement and canting of the lower portion of the jambs 36 and 37 during building construction.

Next, the door frame-fixture assembly 35-15 is positioned at the desired door location, as shown in FIG. 10. The door frame-fixture assembly 35-15 is then braced into a correct vertical alignment by using, for example, a prior art telescoping brace 65. The telescoping brace 65 has a first end 66 connected to the header 38 and a second end 67 connected to a wooden stake 68. A prior art anchor 69 may be used to aid in securing the lower ends of the jambs to the base block course 45.

The masonry wall is then constructed by laying the successive courses of block 54, 55, 56, etc. and by grouting the courses to the respective jambs 36 and 37. When the construction reaches the level of the header 38, normally a load-bearing lintel is mounted adjacent the header 38 in a manner well known in the art. In some cases, depending upon the design loading, the lintel may be eliminated. Alternatively, a reinforced concrete wall may be constructed rather than a masonry wall. In such construction, the side loading forces and possible misalignment of the metallic door frame 35 is even greater under prior art methods than with masonry construction.

In any event, after the wall is completed, the fixture 15 is removed from the metallic frame 35. Lastly, the door hardware is installed and the metallic door (not shown) is hung. It has been found that a door framing-fixture, according to the present invention, and the method of installing a metallic door frame during building construction, according to the present invention, reduces overall construction costs by substantially reducing the chances of misaligned metallic door frames during building construction.

I claim:

1. A door framing-fixture for use with a metallic frame having two opposed jambs and a connecting header, said door framing-fixture comprising a top member, a bottom member, and a pair of opposed side members, said members being connected together to form an integral rectangular fixture complementary with the interior of such metallic frame, said integral rectangular fixture having an exterior periphery, wherein such periphery defines the desired interior alignment of the metallic frame, brace members adjacent said bottom member extending rearwardly for connection to such metallic frame, said brace members being fixed to said bottom member, and a cross member extending between said opposed side members and being integrally attached to said side members.

2. A door framing-fixture for use with a metallic frame having two opposed jambs and a connecting header, one of said jambs including at least two vertically spaced hinge recesses and the other of said jambs including a strike plate recess, said door framing-fixture comprising a top member, a bottom member and a pair of opposed side members, said members being connected together to form an integral rectangular fixture complementary with the interior of such metallic frame, said integral rectangular fixture having an exterior periphery, wherein such periphery defines the desired interior alignment of the metallic frame, brace members attached to said bottom members for connection to such metallic frame, guide plates attached to said side members, said guide plates mating with such hinge recesses and such strike plate recess and an integral cross member extending between said opposed side members.

3. A door framing-fixture, according to claim 2, wherein said members are tubular.

4. A door framing-fixture, according to claim 2, wherein said side members, said bottom member, and said cross member define a wheelbarrow opening.

5. A door framing-fixture according to claim 2, including corner braces mounted adjacent the intersections of said members.

6. A door framing-fixture, according to claim 2, wherein said brace members extend rearwardly for connection to the opposed jambs of the metallic frame.

7. A door framing-fixture, according to claim 3, wherein said tubular members are rectangular in cross section.

8. A door framing-fixture, according to claim 2, wherein such metallic frame includes three hinge recesses on said one jamb and wherein said fixture includes three guide plates on one side member and one guide member on said opposed side member.

9. A door framing-fixture, according to claim 1, wherein one of the jambs of the metallic frame includes at least two vertically spaced hinge recesses and the other one of the jambs including a strike plate recess, and including guide plates attached to said side members, said guide plates mating with such hinge recesses and such strike plate recess.

10. A door framing-fixture, according to claim 9, wherein such metallic frame includes three hinge recesses on said one jamb and wherein said fixture includes three guide plates on one side member and one guide member on said opposed side member.

11. A door framing-fixture, according to claim 1, wherein said members are tubular.

12. A door framing-fixture, according to claim 11, wherein said tubular members are rectangular in cross section.

13. A door framing-fixture, according to claim 1, wherein said opposed side members, said bottom member, and said cross member define a wheelbarrow opening.

14. A door framing-fixture, according to claim 1, including corner braces mounted adjacent the intersections of said members.

* * * * *